US006602011B2

(12) United States Patent
Tanaka

(10) Patent No.: US 6,602,011 B2
(45) Date of Patent: Aug. 5, 2003

(54) BALL POINT PEN

(75) Inventor: Hideyuki Tanaka, Aichi (JP)

(73) Assignee: The Pilot Ink Co., Ltd., Aichi (JP)

( * ) Notice: Subject to any disclaimer, the term of this patent is extended or adjusted under 35 U.S.C. 154(b) by 0 days.

(21) Appl. No.: 09/983,410

(22) Filed: Oct. 24, 2001

(65) Prior Publication Data

US 2002/0154938 A1 Oct. 24, 2002

(30) Foreign Application Priority Data

Oct. 27, 2000 (JP) ..... 2000-328106

(51) Int. Cl.[7] ..... B43K 7/10
(52) U.S. Cl. ..... 401/214; 401/216; 401/209
(58) Field of Search ..... 401/214, 209, 401/208, 212, 215, 216

(56) References Cited

U.S. PATENT DOCUMENTS 5,876,142 A 3/1999 Furukawa
5,984,559 A * 11/1999 Shiobara et al. ..... 401/214
6,299,375 B1 * 10/2001 Abe ..... 401/214

FOREIGN PATENT DOCUMENTS

| | | |
|---|---|---|
| EP | 0 810 103 A1 | 12/1997 |
| EP | 1 024 027 A1 | 8/2000 |
| FR | 2 729 966 | 8/1996 |
| JP | 2577544 | 5/1998 |
| WO | 99/38710 | 8/1999 |

* cited by examiner

*Primary Examiner*—David J. Walczak
(74) *Attorney, Agent, or Firm*—Sughrue Mion, PLLC

(57) ABSTRACT

A spring (5) for pressing a ball (23) forward is disposed within a tip body (2) and a holder (3). The spring (5) includes a straight part (6) and a coil part (7). The straight part (6) is inserted into the tip body (2), and the coil part (7) is disposed within the holder (3). A protrusion (4) is provided on the inner surface of the holder (3). The coil part (7) climbs over the protrusion (4) and its engagement and stopping are set up.

16 Claims, 7 Drawing Sheets

BALL POINT PEN

BACKGROUND OF THE INVENTION

1. Field of the Invention

The present invention relates to a ball point pen. More specifically, the invention relates to a ball point pen in which a spring for pressing forward a ball is provided within a tip body. In the description of the invention to be given hereunder, the word "front" indicates the tip-body side of the ball point pen, and the word "rear" indicates the ink-storage-tube side of the ball point pen.

2. Description of the Related Art

This type of ball point pen is disclosed in Japanese Utility Model No. 2577544, for example. In the ball point pen, a spring for pressing forward a ball comprises a coil part and a straight part. The straight part for pressing the ball forward is inserted into the tip body. The coil part for generating a resilient force is located to the rearward of the tip body. In the publication, the rear end of the coil part is engaged with and stopped by a spring receiving seat as a separate member.

Thus, the conventional ball point pen needs another separate member, such as a spring receiving seat, for engaging and stopping the rear end of the spring. This results in increasing the time and labor of the assembling work, and the number of required component parts. Hence, the cost to manufacture is increased, viz. it is difficult to provide products at low cost to the market.

Further, the conventional ball point pen suffers from the following problem. In the step for assembling the spring into the tip body, the front end of the coil part that has been inserted into the tip body is brought into contact with the rear surface of the ball, and at the same time, the coil part is compressed. The front end of the straight part is caught at the rear end of the ball receiving seat. The spring is assembled into the ball point pen structure in a state that the front end of the straight part is brought into improper contact with the rear surface of the ball. This causes a problem of defective assembling of the spring.

In a case where the tip body is of the type in which a ball is held at the front end of a straight thin tube made of metallic material (called a needle tip), the ink flowing elongated hole within the thin pipe is small in diameter. Accordingly, it is difficult to form a centering guide surface in a rear part of the ball receiving seat. The front end of the straight part of the spring is caught at the rear face of the ball receiving seat, and defective assembling is likely to occur. In a case where the tip body is of the type in which the ball receiving seat is formed by inward press deforming, the rear face of the ball receiving seat is not a smooth slanted surface, the front end of the straight part is caught at the rear face of the ball receiving seat and sometimes fails to come in contact with the rear surface of the ball.

SUMMARY OF THE INVENTION

Accordingly, It is an object of the present invention to provide a ball point pen which does not need an additional separate member with and at which the spring is held and to succeed in reducing the time and labor for the assembling and the number of required component parts, and the cost to manufacture. It is an another object to provide a ball point pen to enable the front end of the straight part to be brought into reliable contact with the rear surface of the ball without the defective assembling.

In order to achieve the above objects, a ball point pen as a first aspect of the invention comprising:

a holder including a front portion;

a tip body including a rear end fastened to the front portion of the holder; and a front end having a tip apex edge portion being formed inwardly curved and a ball receiving seat located rearwardly of the tip apex edge portion;

a ball rotatably held between the tip apex edge portion and the ball receiving seat; and a spring disposed within the tip body and the holder for pressing the ball toward an inner surface of the tip apex edge portion, the spring comprising a straight part passing through inside of the tip body; and a coil part integrally joined to a rear end of the straight part, and disposed within the holder, wherein a protrusion is integrally formed on an inner surface of the holder, and the coil part is held on the protrusion in compressed state.

In the ball point pen thus constructed, the coil part 7 is held on the protrusion 4. With this feature, there is no need of using an additional separate member with and at which the spring is held. This feature reduces the time and labor of assembling, and the cost to manufacture.

As a second aspect of the invention, the coil part comprised a first coil part 72 connected to a rear end of the straight part and a second coil part. The second coil part 71 may be provided on the rear end of the coil part 7, and the second coil part 71 is held on the protrusion 4 in the ball point pen 1.

When comparing with a case where the whole coil part is held on the protrusion 4 on the inner surface of the holder 3 (viz., no second coil part 71 is provided on the coil part 7), only the second coil part 71 is held on the protrusion 4 on the inner surface of the holder 3. Therefore, the stroke that the second coil part 71 is held on the protrusion 4 is reduced to make, the mounting work simple. With the feature of the length reduction of the stroke that the second coil part 71 is held on the protrusion 4, damage of the protrusion 4 is considerably lessened when the coil part 7 is held the protrusion 4.

As the third aspect of the invention, in the ball point pen 1 a length (as viewed in the axial direction) from the front end of the straight part of the spring to the front end of the second coil part, when the spring is in uncompressed state, may be larger than a length (as viewed in the axial direction) from the rear end of the ball to the protrusion on the inner surface of the holder.

In a following explanation the length (as viewed in the axial direction) from the front end of the straight part of the spring to the front end of the second coil part, when the spring is in uncompressed state, is A. The length (as viewed in the axial direction) from the rear end of the ball to the protrusion on the inner surface of the holder is also described as B in following explanation.

The tip body 2 which rotatably holds the ball 23 in the ball embracing part located at the front part thereof, is fastened to the front part 31 of the holder 3. The spring 5 is inserted into the holder 3through its rear end opening. As shown in FIG. 2, during the process to insert the spring 5 into the tip body 2 and the holder 3, the spring 5 is temporarily inserted by a small force (e.g., dropping) through the rear end opening of the holder 3 in a state that straight part 6 is directed forward.

At this time, because of the construction (A>B) the second coil part 71 of the rear end of the coil part 7 does not climb over the protrusion 4 on the inner surface of the holder 3 and hence the second coil part 71 has not held on the protrusion 4 yet. Accordingly, the coil part 7 is not yet compressed. Accordingly, the front end of the straight part 6 is axially movable and also in radial directions. Even if the front end of the straight part 6 is caught at the rear end face of the ball receiving seat 22 and is not in contact with the rear surface of the ball 23, the front end of the straight part 6 may easily and appropriately be brought into contact with the rear surface of the ball 23 by applying a small force (e.g., vibration) thereto. After the front end of the straight part 6 is appropriately brought into contact with the rear surface of the ball 23, the second coil part 71 is held on the protrusion 4 on the inner surface of the holder 3. As a result, the coil part 7 is in a compressed state.

Accordingly, there is no chance that the front end of the straight part 6 is caught by the ball receiving seat 22, and the spring 5 is assembled while it is brought into improper contact with the rear surface of the ball 23. The front end of the straight part 6 is brought into reliable contact with the rear surface of the ball 23, thereby completely suppressing occurrence of the defective assembling.

As forth aspect of the invention, the tip body preferably comprises a straight, metal thin tube in the ball point pen.

The features of the first and forth aspect of the invention operate to produce the following effect: a ball point pen of the type in which the spring 5 for pressing the ball 23 forward is disposed within the tip body 2 as a straight, metal thin tube (called a needle tip) is produced at low manufacturing cost and marketed at low price.

The features of the second and forth aspect of the invention operate to produce the following effect: a ball point pen of the type in which the spring 5 for pressing the ball 23 forward is disposed within the tip body 2 as a straight, metal thin tube (called a needle tip) is produced at lower manufacturing cost and marketed at lower price.

In a case where the tip body 2 is a straight thin tube made of metallic material, the inner diameter of the ink flowing elongated hole 35 located behind the ball embracing part is usually substantially equal to or smaller than the diameter of the ball embracing part. Accordingly, it is difficult to form a centering guide surface in the ink flowing elongated hole 35. The front end of the straight part 6 of the spring 5 is caught at the rear face of the ball receiving seat 22, and defective assembling is likely to occur. Because of this, the construction (A>B) effectively operates, so that the front end of the straight part 6 is brought into reliable contact with the rear surface of the ball 23, thereby completely suppressing occurrence of the defective assembling.

In the tip body 2 as a straight, metal thin tube, usually, the rear outer surface of the tip apex edge part 21 is not tapered. The ball receiving seat 22 of the tip body 2 comes in two varieties: a ball receiving seat 22 formed by inwardly pressing and a ball receiving seat 22 formed by cutting.

DETAILED DESCRIPTION OF THE PREFERRED EMBODIMENTS

Figure 1:
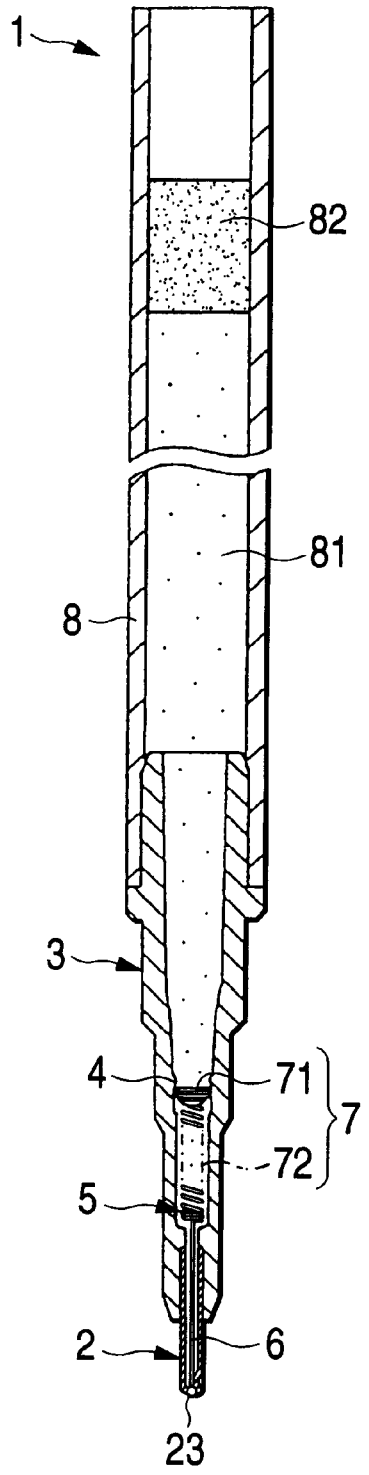
FIG. 1 is a longitudinal sectional view showing an embodiment of a ball point pen.
Figure 2:
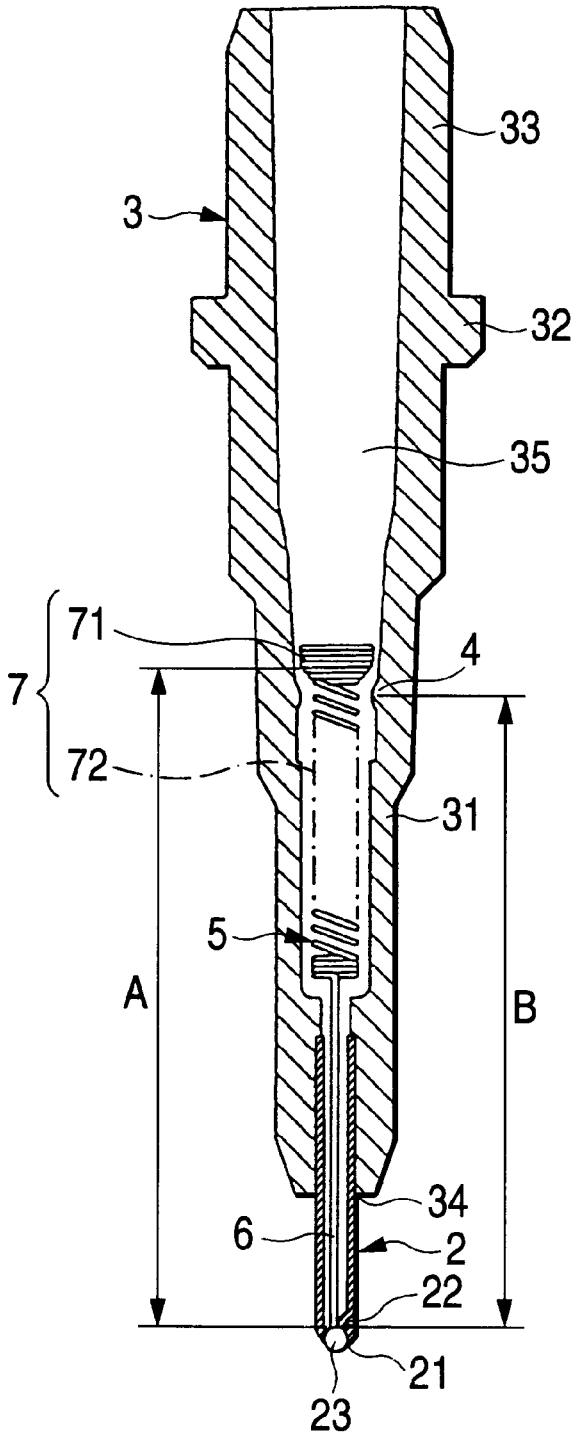
FIG. 2 is an enlarged, longitudinal sectional view showing a temporary insertion of a spring shown in FIG. 1.

The preferred embodiments of the present invention will be described with reference to the accompanying drawings. FIGS. 1 through 5 shows embodiments of the present invention.

A ball point pen 1 constructed according to the present invention is made up of a tip body 2 which rotatably holds a ball 23 at the front end, a holder 3 with its front part 31 into and to which the rear end of the tip body 2 is press fit into and fixed, an ink storage tube 8 having an opening at the front end into and to which the rear part 33 of the holder 3 is press fit and fixed, and a spring 5 placed in the tip body 2 and the holder 3.

The ink storage tube 8 is a tubular body, which is opened at both ends and formed by resin protrusion molding. The rear part 33 of the holder 3 with the tip body 2 is press fit into and to the front end opening of the ink storage tube 8. The rear end of the ink storage tube 8 is opened to allow air to flow therethrough.

The ink storage tube 8 is filled with an ink 81, and grease like follower 82 which is located at the rear end of the ink 81 and moves forward with consumption of the ink 81. (e.g., An aqueous ink has a shear thinning viscosity. An oil ink has a medium viscosity.)

The tip body 2 comprises a straight thin tube made of metallic material (e.g., stainless steel). The front end of the tip body 2 is inwardly deformed by pressing to form a tip apex edge part 21 inwardly curved and a ball receiving seat 22 located rearwardly of the tip apex edge part. A ball 23 is rotatably held at a location (ball embracing part)between the tip apex edge part 21 and the ball receiving seat 22. In the embodiment, the ball receiving seat 22 comprises a plurality (e.g., 3 to 4) of inwardly curved protrusions. If required, it may be annular shaped.

The holder 3 is a tubular member made of synthetic resin (e.g., polyacetal) by injection molding. The holder 3 includes a front part 31 tapered to its extremity, a collar part 32 brought into contact with the front end face of the ink storage tube 8, and a rear part 33 press fit into the front end opening of the ink storage tube 8. The tip body 2 is attached to a front part 31. A tip mounting hole 34 of which the front end is opened, and an ink flowing elongated hole 35 which communicates with the tip mounting hole 34 and the rear end of which is opened to exterior are provided within the holder 3. The inside diameter of the ink flowing elongated hole 35 is larger than that of the tip mounting hole 34. A plurality (e.g., 4) of protrusions 4, while being angularly arranged, are provided on the inner surface of a mid position of the ink flowing elongated hole 35. The protrusion 4 may be replaced with an annular member.

The spring 5 is made of a stainless steel wire of 0.14 mm in diameter. The spring comprises a straight part 6 as its front part and a coil part 7 as its rear part. The coil part 7 comprises a first coil part 72 and second coil part 71. A second coil part 71 is formed at the rear part of the coil part 7. The outside diameter of the second coil part 71 is larger than that of the first coil part 72. The second coil part 71 is formed by close-wound coil.

In the embodiment, a length A (as viewed in the axial direction) from the front end of the straight part 6 of the spring 5 to the front end of the second coil part 71 when the spring 5 is in uncompressed state is 13.2 mm. A length B from the rear end of the ball 23 to the protrusion 4 on the inner surface of the holder 3, when the tip body 2 and the holder 3 are fastened, is 12.6 mm. Thus, the length A is larger than the length B (i.e., A>B).

An outside diameter D of the second coil part 71 is slightly larger than an inside diameter C of the array of the protrusion 4 (the inside diameter C= the diameter of an inscribed circle of those protrusion 4 in the embodiment). The inner diameter of the ink flowing elongated hole 35 of the holder 3 at positions before and after the protrusion 4 is slightly larger than the outside diameter D of the second coil part 71. With the above feature, the outer surface of the second coil part 71 is not caught by the inner surfaces of the ink flowing elongated hole 35 at positions before and after the protrusion 4. Thereby, the second coil part 71 is appropriately held at the protrusion 4.

The ball point pen 1 of the embodiment operates when it is not used for writing in the following way. The ball 23 is forwardly pressed by the spring 5,and pressed against the inner surface of the tip apex edge part 21. As a result, the pen point is sealed. Accordingly, even when the ball point pen is left with its pen point directed downward, no ink leaks from the pen point. Even when it is left with its pen point directed upward, no air enters the ball point pen through the pen point.

Figure 3:
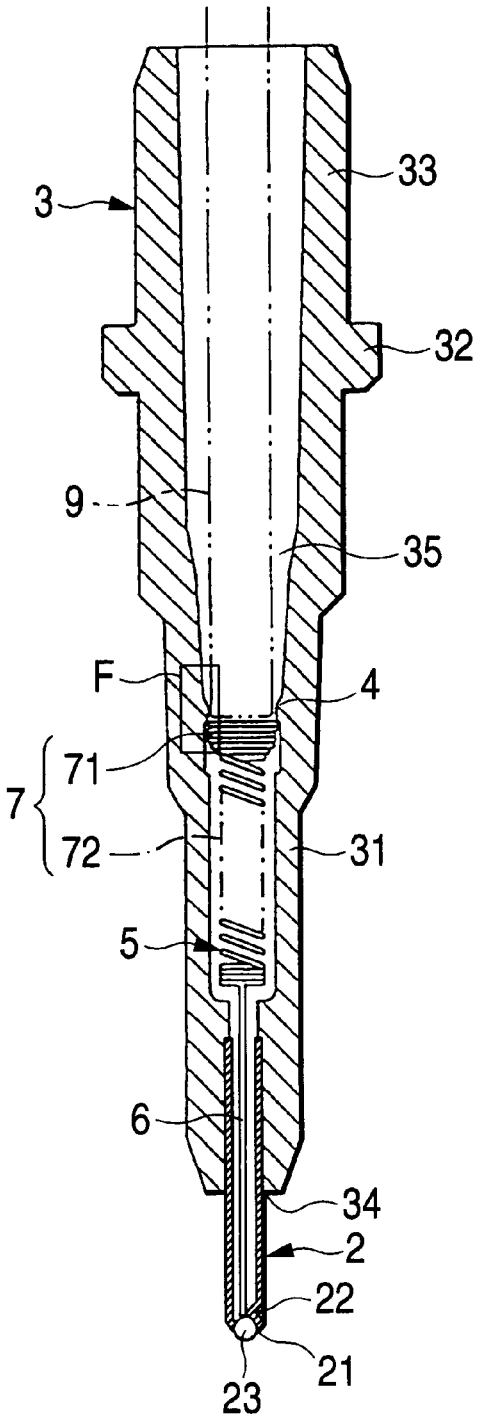
FIG. 3 is an enlarged, longitudinal sectional view showing a state of completing the assembling of the spring shown in FIG. 1.
Figure 4:
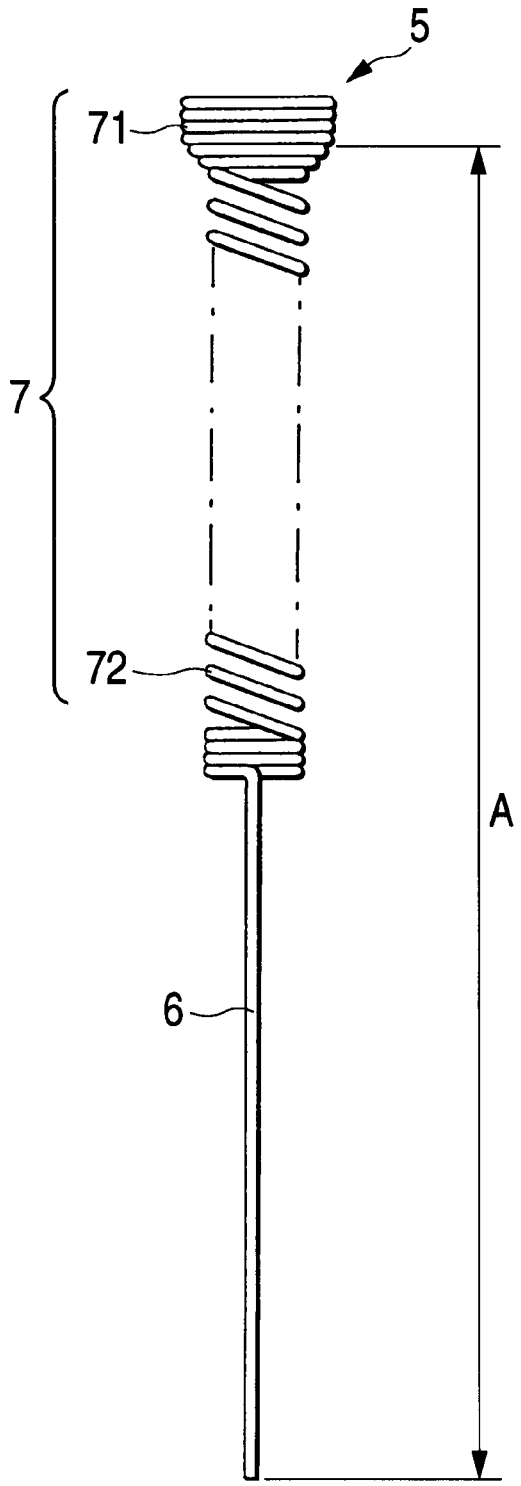
FIG. 4 is an enlarged longitudinal diagram showing the spring as shown in FIG. 2.
Figure 5:
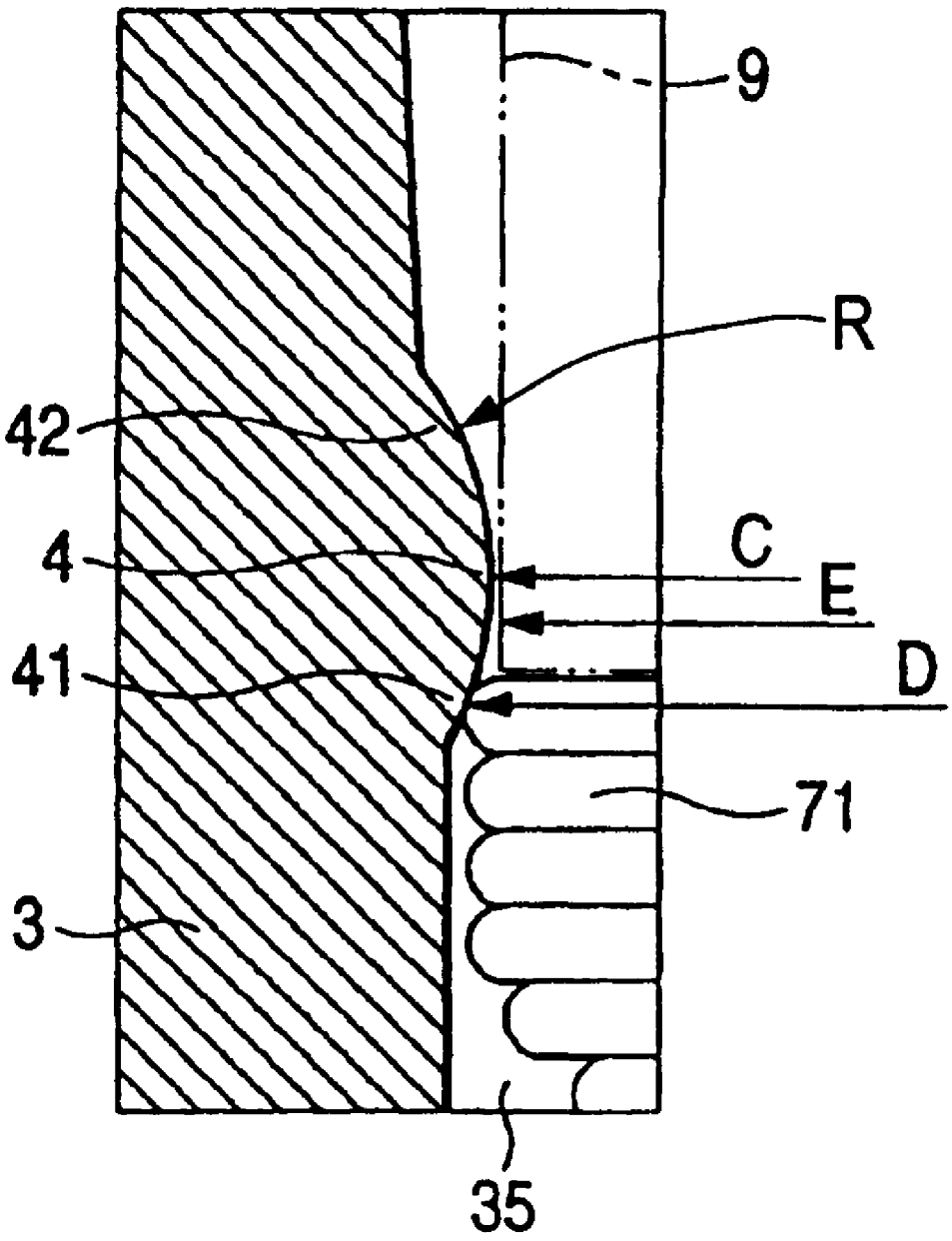
FIG. 5 is an enlarged view showing a part F in FIG. 3.

As shown in FIGS. 3 and 5, when the second coil part 71 is moved to hold at the protrusion 4, a pushing bar 9 is inserted into the rear end opening of the holder 3 to put on the rear end of the second coil part 71, and the second coil part 71 is pushed forward with the pushing bar 9. The outside diameter E of the pushing bar 9 is slightly smaller than the inner diameter C of the array of the protrusion 4 (E<C). Therefore, the second coil part 71 is pushed forward to climb over the protrusion 4 with the pushing bar 9. Further, the outside diameter E of the pushing bar 9 is slightly smaller than the inner diameter of the rear end of the second coil part 71. Accordingly, the front end of the pushing bar 9 is reliably brought into contact with the rear end of the second coil part 71 with no fear that the pushing bar 9 is inserted into the coil part 7.

Figure 6:
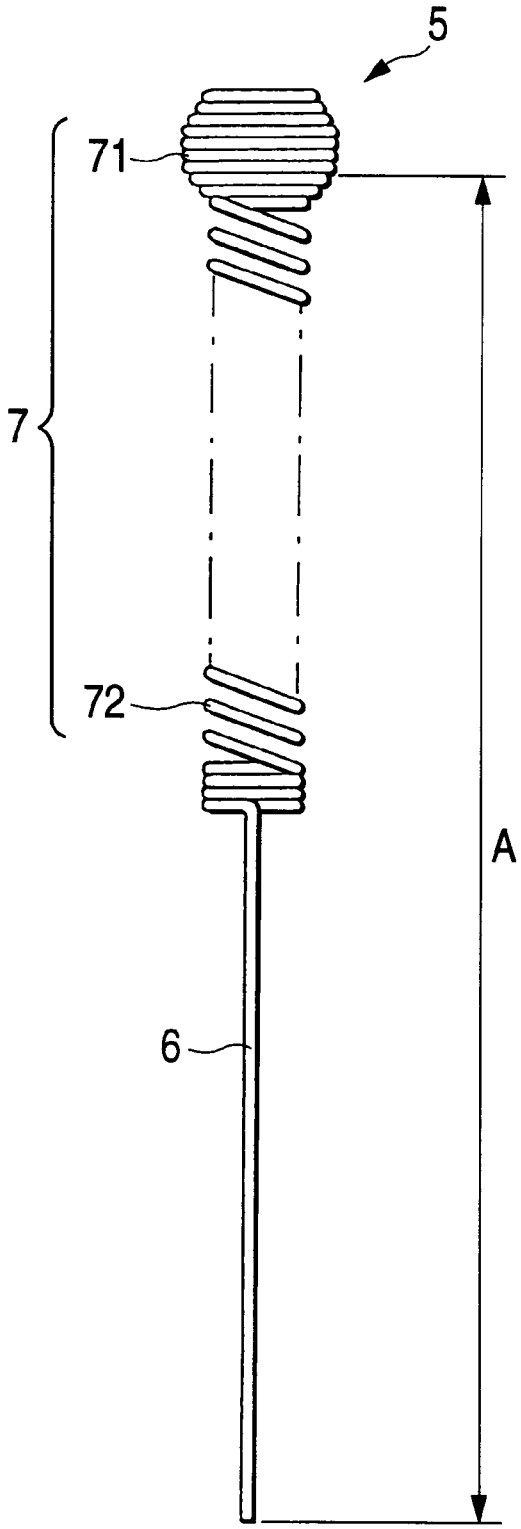
FIG. 6 is an enlarged view showing another spring.

Another embodiment of the spring 5, which may be used for the present invention, is shown in FIG. 6. The spring 5, as in the above-mentioned embodiment (FIG. 4), includes a straight part 6 and a coil part 7. The spring 5 is different from the above-mentioned one in that the second coil part 71 formed at the rear end of the coil part 7 is reduced in diameter toward the rear side. With such a configuration of the second coil part, the rear end of the second coil part 71 is reliably brought into contact with the front end face of the pushing bar 9. A ball point pen using the spring 5 (FIG. 6) of the embodiment under discussion in place of the spring 5 of the above-mentioned embodiment (FIGS. 1 through 5), will produce an effect similar to that in the above-mentioned embodiment.

Figure 7:
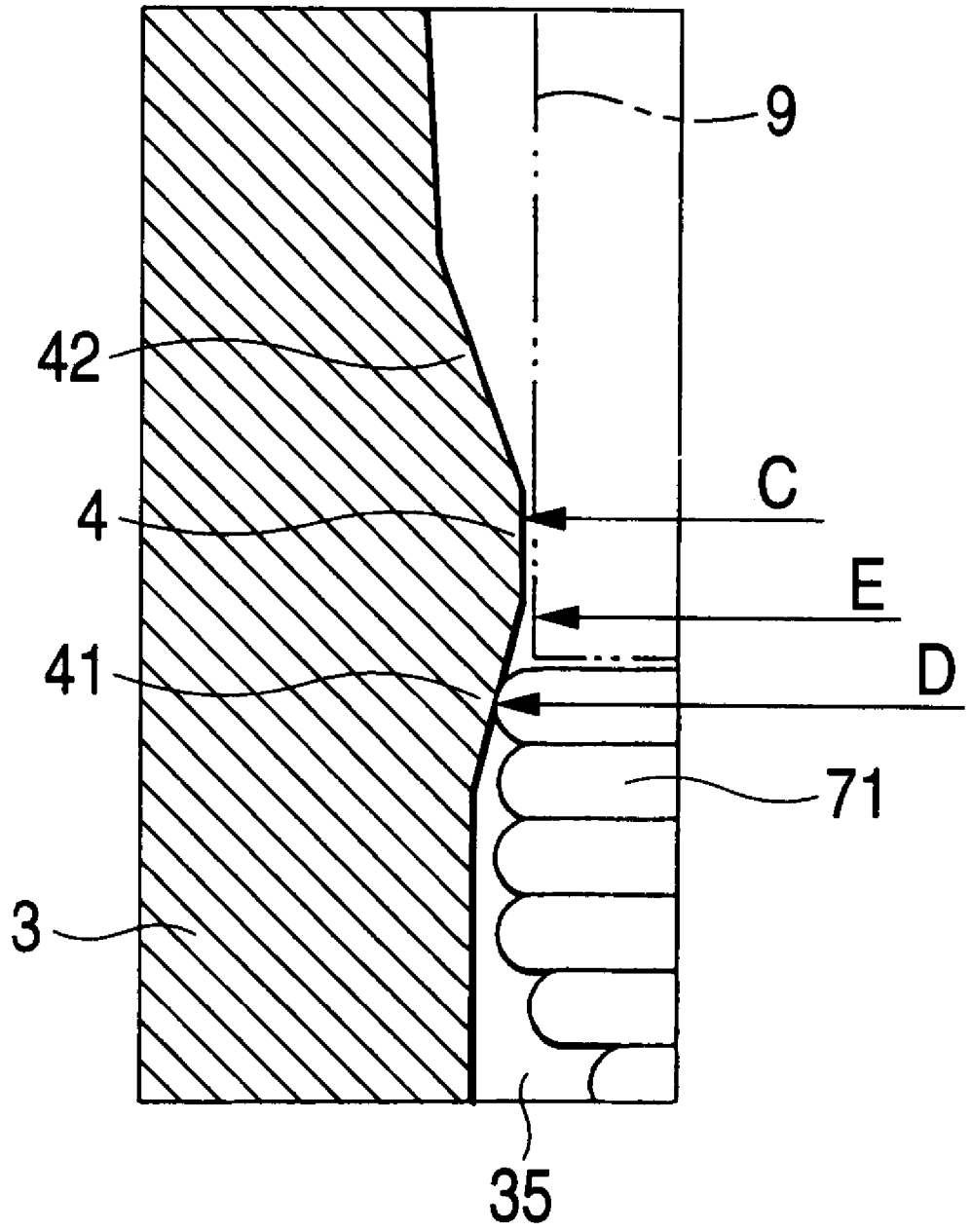
FIG. 7 is an enlarged view showing another form of the slanted surfaces of the protrusion.

In the invention, it is useful to configure a front surface 41 and a rear surface 42 of each protrusion 4 so as to have slanted surfaces (curved surfaces of curvature R as shown in FIG. 5 or tapered surfaces as shown in FIG. 7). If the front surface 41 of the protrusion 4 is configured to be slanted, it is easy to pull a core pin of a mold out of the inner surface of a molded product, which has protrusion 4 (undercut) of the holder 3 in the process of synthetic resin injection molding. If the rear surface 42 of the protrusion 4 is configured to be slanted, the second coil part 71 smoothly climbs over the protrusion 4.

As seen from the foregoing description, in the invention the coil part is held on the protrusion on the inner surface of the holder. With this feature, there is no need of using an additional separate member with and at which the spring is engaged and stopped. This feature reduces the time and labor of assembling, and the cost to manufacture.

When comparing with a case where the whole coil part is held on the protrusion on the inner surface of the holder and stopped in an engaging fashion, only the second coil part climbs over the protrusion on the inner surface of the holder. Therefore, the climbing stroke is reduced, and the mounting work is simple. With the feature of the length reduction of the climbing stroke, damage of the protrusion which will be caused by their contact with the coil part, when the coil part climbs over the protrusion is considerably lessened.

The front end of the straight part 6 is brought into reliable contact with the rear surface of the ball 23, thereby completely suppressing occurrence of the defective assembling.

A ball point pen of the type in which the spring 5 for pressing the ball forward is disposed within the tip body as a straight, metal thin tube (called a needle tip) is produced at lower manufacturing cost and marketed at lower price. Also in the manufacturing the ball point pen of the above type, the front end of the straight part is brought into reliable contact with the rear surface of the ball, thereby completely suppressing occurrence of the defective assembling.

What is claimed is:

1. A ball point pen comprising:

a holder including a front portion;

a tip body including a rear end fastened to the front portion of the holder; and a front end having a tip apex edge portion being formed inwardly curved and a ball receiving seat located rearwardly of the tip apex edge portion;

a ball rotatably held between the tip apex edge portion and the ball receiving seat; and a spring disposed within the tip body and the holder for pressing the ball toward an inner surface of the tip apex edge portion, the spring comprising:

a straight part passing through an inside of the tip body; and a coil part integrally joined to a rear end of the straight part, and disposed within the holder, wherein a protrusion is integrally formed on an inner surface of the holder, so that the coil part is capable of climbing over the protrusion to change from an uncompressed to a compressed state.

2. The ball point pen according to claim 1, wherein the coil part comprises:

a first coil portion connected to a rear end of the straight part and a second coil portion.

3. The ball point pen according to claim 2, wherein the second coil portion is formed by closed-wound coil.

4. The ball point pen according to claim 2, wherein an outer diameter of the first coil portion, which is substantially constant, is smaller than that of the second coil portion.

5. The ball point pen according to claim 2, wherein an inner diameter of the holder at a position where the protrusion is formed is smaller than an outer diameter of the second coil portion.

6. The ball point pen according to claim 1, wherein a length of the spring in an axial direction of the ball point pen from the front end of the straight part to the front end of the second coil portion, when the spring is in uncompressed state, is longer than a distance in the axial direction from the rear end of the ball to the protrusion on the inner surface of the holder.

7. The ball point pen according to claim 1, wherein the tip body comprises a straight, metal thin tube.

8. The ball point pen according to claim 1, wherein the ball receiving seat is formed by pressing inwardly at the front end of the tip body.

9. The ball point pen according to claim 1, wherein the holder is formed by resin injection molding.

10. The ball point pen according to claim 1, wherein the front and rear end surfaces of the protrusion are tapered.

11. The ball point pen according to claim 1, wherein an inner diameter of the holder at a position where the protrusion is formed is smaller than an outer diameter of the coil part.

12. The ball point pen according to claim 1, wherein the holder is made of synthetic resin.

13. The ball point pen according to claim 1, wherein the protrusion includes a plurality of inwardly projecting portions formed on the inner surface of the holder.

14. The ball point pen according to claim 1, wherein the protrusion is annular shaped.

15. A ball point pen comprising:

a holder including a front portion;

a tip body including a rear end fastened to the front portion of the holder; and a front end having a tip apex edge portion being formed inwardly curved and a ball receiving seat located rearwardly of the tip apex edge portion;

a ball rotatably held between the tip apex edge portion and the ball receiving seat; and a spring disposed within the tip body and the holder for pressing the ball toward an inner surface of the tip apex edge portion, the spring comprising a straight part passing through inside of the tip body; and a coil part integrally joined to a rear end of the straight part, and disposed within the holder, wherein a protrusion is integrally formed on an inner surface of the holder, so that the coil part is capable of climbing over the protrusion to change from an uncompressed to a compressed state, wherein the coil part comprises a first coil portion connected to a rear end of the straight part and a second coil portion, wherein the second coil portion is formed by closed-wound coil, and wherein outer diameters of the second coil portion varies in the axial direction.

16. The ball point pen according to claim 1, wherein the tip body is made of stainless steel.

* * * * *